US009134030B2

(12) United States Patent
Bathina et al.

(10) Patent No.: US 9,134,030 B2
(45) Date of Patent: Sep. 15, 2015

(54) MICROMIXER OF TURBINE SYSTEM

(75) Inventors: Mahesh Bathina, Andhra Pradesh (IN); Vaibhav Nadkarni, Madhya Pradesh (IN); Arjun Singh, Madhya Pradesh (IN)

(73) Assignee: General Electric Company, Schenectady, NY (US)

( * ) Notice: Subject to any disclaimer, the term of this patent is extended or adjusted under 35 U.S.C. 154(b) by 885 days.

(21) Appl. No.: 13/356,183

(22) Filed: Jan. 23, 2012

(65) Prior Publication Data

US 2013/0186092 A1 Jul. 25, 2013

(51) Int. Cl.

| | |
|---|---|
| ***F23R 3/04*** | (2006.01) |
| ***F23R 3/16*** | (2006.01) |
| ***F23R 3/54*** | (2006.01) |

(52) U.S. Cl.

CPC . *F23R 3/045* (2013.01); *F23R 3/16* (2013.01); *F23R 3/54* (2013.01)

(58) Field of Classification Search

CPC ..... F23R 3/04; F23R 3/045; F23R 3/16; F23R 3/24; F23R 3/286; F23R 3/32; F23R 3/40; F23R 3/54

See application file for complete search history.

(56) References Cited

U.S. PATENT DOCUMENTS

| | | | | |
|---|---|---|---|---|
| 4,087,962 | A * | 5/1978 | Beremand et al. | 60/737 |
| 5,713,206 | A * | 2/1998 | McWhirter et al. | 60/747 |
| 8,147,121 | B2 * | 4/2012 | Lacy et al. | 366/134 |
| 8,209,986 | B2 * | 7/2012 | Lacy et al. | 60/737 |
| 8,322,143 | B2 * | 12/2012 | Uhm et al. | 60/737 |
| 2003/0167771 | A1 * | 9/2003 | Hayashi et al. | 60/737 |
| 2004/0216463 | A1 | 11/2004 | Harris | |
| 2011/0094235 | A1 | 4/2011 | Mulherin et al. | |

FOREIGN PATENT DOCUMENTS

| | | | |
|---|---|---|---|
| EP | 1174662 | A1 | 1/2002 |
| GB | 579424 | A | 8/1946 |
| WO | 2011139309 | A2 | 11/2011 |

OTHER PUBLICATIONS

Search Report and Written Opinion from EP Application No. 13152028.0 dated Mar. 28, 2013.

* cited by examiner

*Primary Examiner* — Phutthiwat Wongwian
*Assistant Examiner* — Arun Goyal

(57) ABSTRACT

A micromixer of a turbine system is provided and the micromixer includes a plurality of pipes each having an inlet and an outlet for receiving flow and dispersing the flow to a combustor. Also provided is a non-uniform inlet arrangement defined by the inlets of the plurality of pipes, wherein at least one of the inlets extends to an axial location distinct from at least one other inlet.

7 Claims, 4 Drawing Sheets

MICROMIXER OF TURBINE SYSTEM

BACKGROUND OF THE INVENTION

The subject matter disclosed herein relates to turbine systems, and more particularly to a micromixer.

Turbine systems may include a micromixer, where air distribution to an individual air-fuel pipe should remain at a mean average value of the overall flow. The micromixer typically includes a plurality of pipes or tubes, each having an inlet, where the plurality of inlets are all located in a single, defined axial plane. Due to upstream conditions, such as the flow experiencing a sharp turn just prior to entering the inlets, non-uniform mass flow often prevails, thereby hindering overall system performance.

BRIEF DESCRIPTION OF THE INVENTION

According to one aspect of the invention, a micromixer of a turbine system includes a plurality of pipes each having an inlet and an outlet for receiving flow and dispersing the flow to a combustor. Also provided is a non-uniform inlet arrangement defined by the inlets of the plurality of pipes, wherein at least one of the inlets extends to an axial location distinct from at least one other inlet.

According to another aspect of the invention, a turbine system includes a combustor having an outer liner. Also included is a flow sleeve surroundingly enclosing the outer liner proximate a head end of the combustor, wherein air flows upstream between the flow sleeve and the outer liner. Further included is a micromixer disposed proximate the head end and including a plurality of pipe inlets, wherein the plurality of pipe inlets define a non-uniform inlet contour.

According to yet another aspect of the invention, a turbine system includes a combustor. Also included is a micromixer disposed proximate a head end of the combustor, the micromixer including a plurality of pipes each extending along a longitudinal axis, each of the plurality of pipes extending along a longitudinal axis, each of the plurality of pipes having an inlet and an outlet. Further included is a transverse plane aligned relatively perpendicular to the longitudinal axis and located proximate to at least one of the inlets of the plurality of pipes, wherein at least one inlet of the plurality of pipes extends upstream through the transverse plane, thereby defining a non-uniform inlet arrangement.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
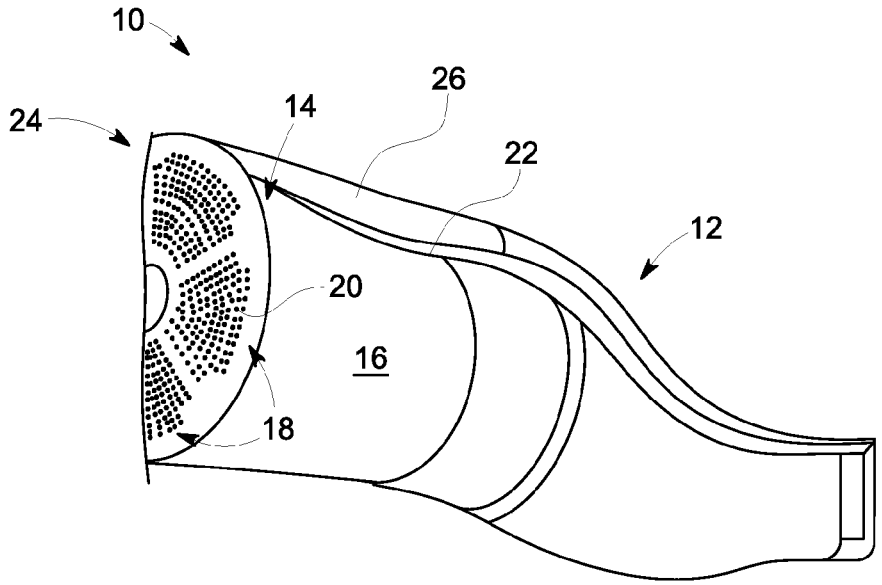
FIG. 1 is a perspective view of a turbine system having a micromixer located in a head end.

Referring to FIG. 1, illustrated is a turbine system 10 having a combustor section 12 and a head end 14. The head end 14 is disposed at an adjacent upstream location of the combustor section 12 and includes a micromixer 16. The micromixer 16 includes a plurality of sectors 18 that each comprise a plurality of pipes 20. The combustor section 12 is defined by an outer liner 22 that extends to an upstream end 24. Spaced radially outwardly of the outer liner 22, and surroundingly enclosing the outer liner 22, is a flow sleeve 26. A flow 28 of air passes upstream within an air passage 30 defined by the outer liner 22 and the flow sleeve 26 to the upstream end 24 of the outer liner 22.

Figure 2:
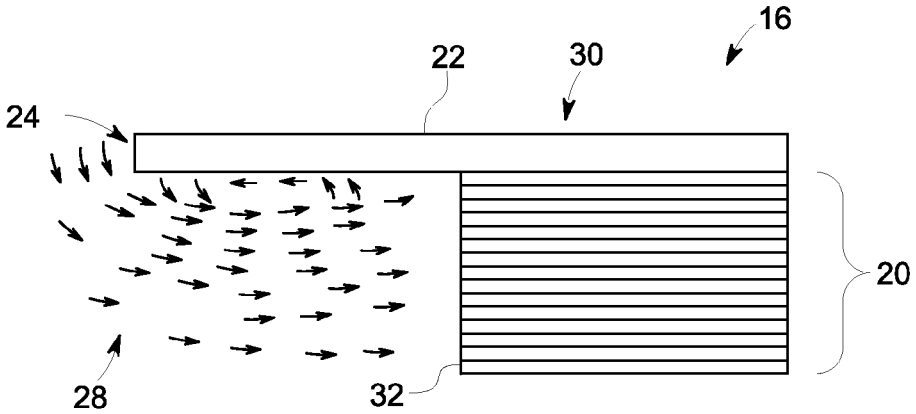
PRIOR ART FIG. 2
FIG. 2 is a side elevational view of a flow preparing to enter a plurality of pipes of the micromixer.

Referring to FIG. 2, upon reaching the upstream end 24 of the outer liner 22, the flow 28 makes an abrupt turn just prior to entering the micromixer 16. The plurality of pipes 20 each include an inlet 32 for receiving the flow 28. It is apparent that pipes disposed at an outer region of the plurality of sectors 18 (i.e., proximate the outer liner 22) do not receive the flow 28 at a pressure or flow rate comparable to that of pipes disposed proximate a central region of the plurality of sectors 18, due to the abrupt turn necessitated by the arrangement illustrated in FIG. 2.

Figure 3:
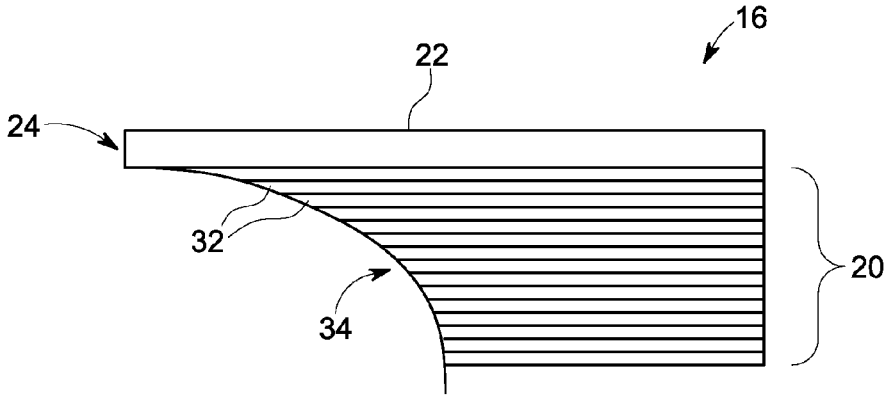
FIG. 3 is a side elevational view of an embodiment of the micromixer having pipes of varying lengths.

Referring to FIG. 3, the inlets 32 of the plurality of pipes 20 extend upstream to various axial locations. In the illustrated example, a non-uniform inlet arrangement 34 in the form of a parabolic formation results from the varying inlet 32 extension. Such an embodiment reduces the formation of vortices present in the flow 28 after making the abrupt turn, thereby resulting in a more uniform overall mass flow throughout the plurality of pipes 20. The parabolic formation induces pressure differences seen at the inlet 32 of the plurality of pipes 20. The non-uniform inlet arrangement 34 may be manipulated and fine-tuned to produce a uniform mass flow throughout the plurality of pipes 20.

Figure 4:
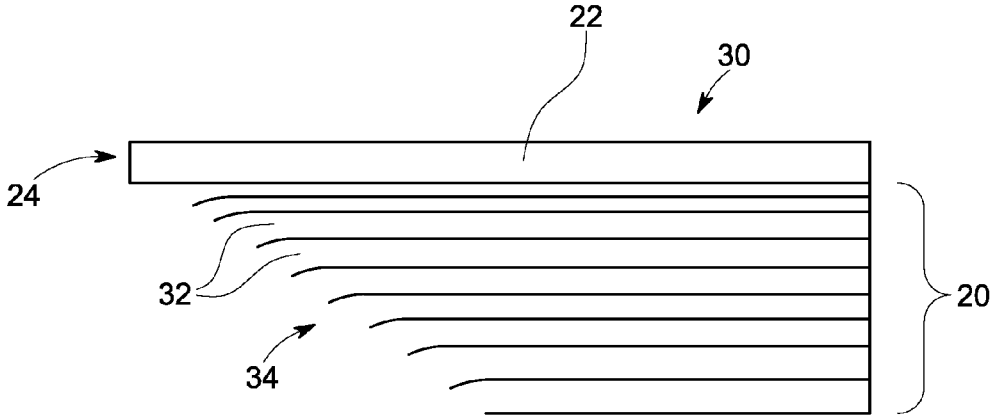
FIG. 4 is a side elevational view of an embodiment of the micromixer having non-linear pipes.
Figure 5:
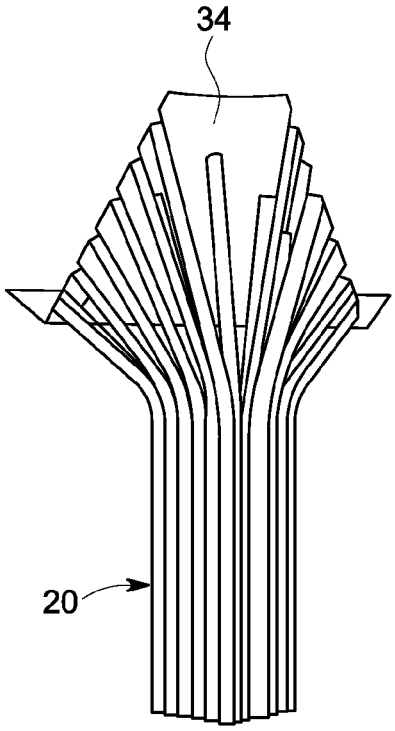
FIG. 5 is a top plan view of the micromixer having non-linear pipes of FIG. 4.

Referring to FIGS. 4 and 5, it is shown that in addition to a non-uniform inlet arrangement 34 that includes a variance of the axial location for the inlets 32 of the plurality of pipes 20, an introduction of curvature on the plurality of pipes 20 proximate the inlets 32 enhances overall mass flow uniformity throughout the micromixer 16. This is achieved by angling regions of the plurality of pipes 20 proximate the inlets 32, thereby forming angled inlet portions 36 that are aligned to more capably receive the flow 28 in a manner that does not result in unnecessary pressure drops throughout the respective pipes 20.

Figure 6:
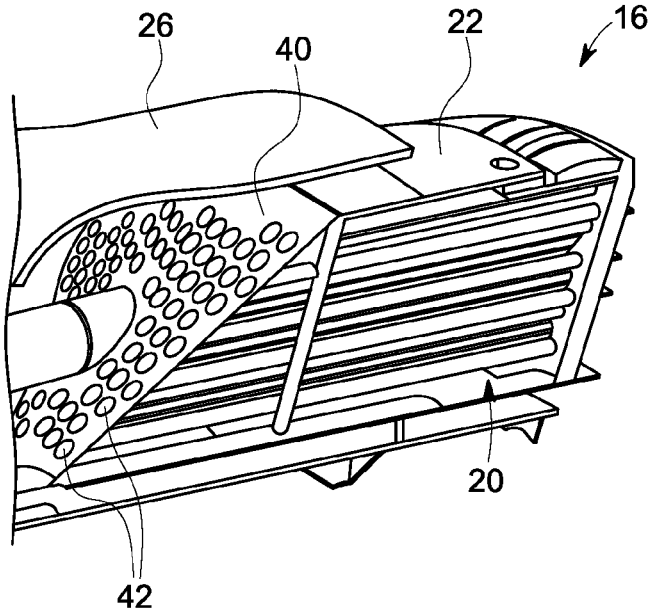
FIG. 6 is a perspective view of an embodiment of the micromixer including an angled face having a plurality of elliptical apertures that align in a flush relationship with a plurality of inlets of the plurality of pipes.

Referring to FIG. 6, an embodiment of the micromixer 16 is illustrated having an angled face 40 that includes a plurality of apertures 42. The plurality of apertures 42 are aligned to receive at least a portion of the inlets 32 of the plurality of pipes 20. The angled face 40 is oriented such that pipes proximate an outer region of the sector 18 are shorter in length than that of pipes proximate the more radially inward pipes. The angled face 40 improves uniformity of air distribution into the head end 14 by allowing the flow 28 to avoid taking an abrupt turn into the head end 14 region, instead making the transition more gradually and providing a more uniform distribution of the flow 28, while reducing pressure drop throughout the plurality of pipes 20.

In the illustrated embodiment, the inlets 32 of the plurality of pipes 20 extend to meet the plurality of apertures 42 in a flush manner, such that each surface of the inlets 32 slopes in a downstream direction as each surface moves radially outward. This configuration provides for the flush relationship between each inlet 32 surface and corresponding apertures 42. The flush relationship between the inlet 32 and the plurality of apertures 42 causes the inlet 32 geometry to be relatively elliptical.

Figure 7:
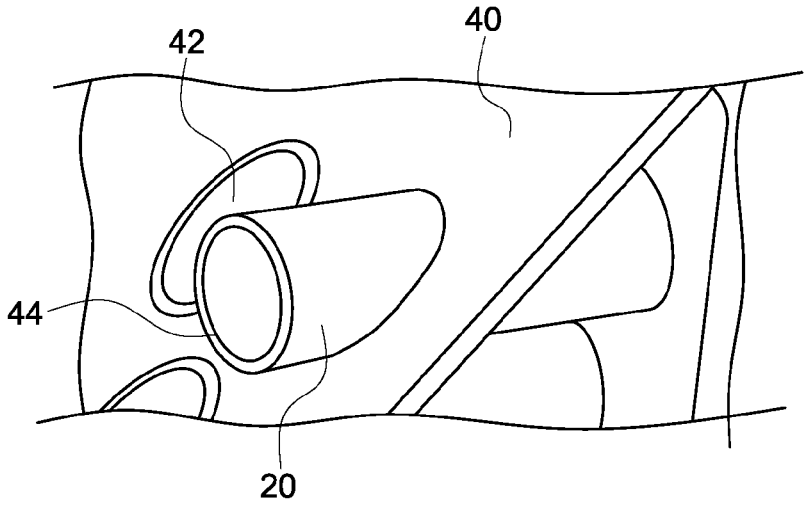
FIG. 7 is an enlarged perspective view of an embodiment of the micromixer including the angled face, wherein the plurality of inlets of the plurality of pipes extend through the apertures.

Referring to FIG. 7, an embodiment of the micromixer 16 having the angled face 40 is shown. Similar to the embodiment described with respect to FIG. 6, the angled face 40 includes the plurality of apertures 42 that are configured to receive the inlets 32 of the plurality of pipes 20. In this embodiment, a surface 44 of each inlet 32 is flat and in a single plane that is substantially perpendicular to a longitudinal axis of the respective pipe. Rather than forming a flush relationship where the inlets 32 extend only to the plurality of apertures 42, the inlets 32 extend beyond the plurality of apertures 42 to an axial location upstream of the respective apertures 42, thereby forming circular entries to the plurality of pipes 20.

Although the angled face 40 described and shown in FIGS. 6 and 7 have a specific direction of angulation, that being less than relatively 90 degrees between the angled face and the longitudinal axis of the plurality of pipes 20, it should be appreciated that the angle of the angled face 40 may vary. Additionally, the angled face 40 may not necessarily be disposed in a single plane, instead taking on any contoured shape that provides a suitable approach for the flow 28 into the micromixer 16.

The micromixer 16 embodiments described above advantageously provide enhanced uniformity for head end 14 flow distribution into the plurality of pipes 20, as well as a reduction in pressure drop seen across the plurality of pipes 20. These benefits result in more uniform fuel-air mixing and an improvement in overall turbine system 10 efficiency.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A micromixer of a turbine system comprising:

a plurality of pipes each having an inlet and an outlet for receiving a flow and dispersing the flow to a combustor; and a non-uniform inlet arrangement defined by the inlets of the plurality of pipes, wherein the inlets of the plurality of pipes are arranged in a parabolic formation such that a longest one of the plurality of pipes is radially outermost from a centerline of the micromixer and a shortest one of the plurality of pipes is closest to the centerline.

2. The micromixer of claim 1, further comprising a plurality of pipe sectors, each of the plurality of pipe sectors including a portion of the plurality of pipes.

3. A turbine system comprising:

a combustor having an outer liner;

a flow sleeve surroundingly enclosing the outer liner proximate a head end of the combustor, wherein a flow travels upstream between the flow sleeve and the outer liner; and a micromixer disposed proximate the head end and including a plurality of pipe inlets, wherein the inlets of the plurality of pipes are arranged in a parabolic formation such that a longest one of the plurality of pipes is radially outermost from a centerline of the micromixer and a shortest one of the plurality of pipes is closest to the centerline.

4. The turbine system of claim 3, further comprising a plurality of pipe sectors, each of the plurality of pipe sectors including a portion of the plurality of pipe inlets.

5. The turbine system of claim 3, wherein the outer liner includes an upstream axial end, wherein the flow passes over the outer liner and around the upstream axial end.

6. The turbine system of claim 5, wherein at least one of the inlets extends axially to the upstream axial end of the outer liner.

7. A turbine system comprising:

a combustor;

a micromixer disposed proximate a head end of the combustor, the micromixer including a plurality of pipes each extending along a longitudinal axis, each of the plurality of pipes having an inlet and an outlet; and a transverse plane aligned relatively perpendicular to the longitudinal axis and located proximate to one of the inlets of the plurality of pipes, wherein each of the plurality of pipes extends upstream through the transverse plane to a respective pipe inlet located at an axial location that is distinct from every other pipe inlet, thereby defining a non-uniform inlet arrangement comprising a parabolic formation such that a longest one of the plurality of pipes is radially outermost from a centerline of the micromixer and a shortest one of the plurality of pipes is closest to the centerline.

* * * * *